US005201594A

United States Patent [19]

Adinolfi et al.

[11] Patent Number: 5,201,594

[45] Date of Patent: Apr. 13, 1993

[54] NAIL SAVER EXTENSION KEYS

[76] Inventors: Raphael Adinolfi, 515 72 St., Brooklyn, N.Y. 11209; Axa Larriuz-Moe, 914 E. 19 St., Brooklyn, N.Y. 11230

[21] Appl. No.: 895,719

[22] Filed: Jun. 9, 1992

[51] Int. Cl.[5] ..... B41J 5/16

[52] U.S. Cl. ..... 400/490; 400/472

[58] Field of Search ..... 400/490, 491, 492, 493, 400/495, 496, 719, 472, 493.1, 493.2, 479, 479.1, 479.2

[56] References Cited

U.S. PATENT DOCUMENTS

| | | | |
|---|---|---|---|
| 2,435,130 | 10/1944 | Cunningham | 400/490 |
| 2,484,866 | 10/1949 | Henry | 400/490 |
| 4,100,402 | 7/1978 | Lundstrom et al. | 400/490 |
| 4,769,516 | 9/1988 | Allen | 400/485 |

FOREIGN PATENT DOCUMENTS

| | | | |
|---|---|---|---|
| 2152437 | 8/1985 | United Kingdom | 400/496 |

OTHER PUBLICATIONS

Shelkofsky "Changeable Keyboard" IBM Technical Disclosure Bulletin vol. 21, No. 10 Mar. 1979 p. 4098.

*Primary Examiner*—Edgar S. Burr
*Assistant Examiner*—Anthony H. Nguyen

[57] ABSTRACT

Keys of an electronic keyboard shaped in a novel way, in order to permit the comfortable operation of the keys, especially by a business machine operator with long fingernails. Because of those changes in the key shape and character placement, the opportunity to set the plane of use of a keyboard anterior-posteriorly into an unlimited number of positions from a strong posterior tilt to a moderate anterior tilt, is thus afforded, giving increased comfort to keyboard operators, regardless of the length of their fingernails.

14 Claims, 8 Drawing Sheets

NAIL SAVER EXTENSION KEYS

BACKGROUND OF THE INVENTION

1. Field of the Invention

The invention relates generally to the keys of an electronic keyboard, shaped in a novel way to permit comfortable operation by a typist or other business machine operator with long fingernails, as well as offering increased comfort of operation to all keyboard operators because the novel keys will permit a wide range of placement of the anterior-posterior plane that a keyboard is positioned in, varying from vertical with the keys facing away from the operator, through horizontal with the keys facing upward, to vertical with the keys facing toward the operator.

2. Description of the Prior Art

Heretofore the form and positioning of an electronic keyboard was largely patterned after its predecessor, the mechanical typewriter. The contact surface of the keys of an electronic keyboard have been shaped in a broad and flat fashion, much as in the old mechanical typewriter. This form, while necessary to allow operation of the keys of a mechanical typewriter, owing to requirements for a broad distribution of force across the fingertips, is not necessary for the operation of the keys of an electronic keyboard, as simple electrical contact is all that is necessary and not the moving of a mechanical device. No design has been put forth that has taken advantage of the potential of electronically operated business machines to permit, by lateral constiction of the key width, operators with long nails to have improved precision and freedom of movement when operating the keys. Also, the unchanging placement of the characters on a keyboard on top of the keys has restricted the freedom to substantially tip the keyboard anterior-posteriorly into varied, more comfortable planes for operators of business machine keyboards.

While the level of keys has been raised by keyboard covers, the form of the surface of the keyboard has remained essentially the same. The present invention endeavors to provide space enough between the keys to allow stylishly long nails to protrude downward below the finger-contacting surfaces of the tops of the keys.

Also, although in one embodiment of the present invention, the surface is covered with a protective sheet, as recited by Parker in U.S. Pat. No. 4,922,980, that is incidental to the prime purposes of the invention, which are to provide access and positioning for comfortable manipulation of the keys by the fingers of a business machine operator with long fingernails, as well as to have keys that allow much freedom of rotation anterior-posteriorly of the plane that the keyboard is placed in.

SUMMARY OF THE INVENTION

The invention relates to a modification of the usual shape of keyboard keys from broad and flat and tightly arranged to narrow and raised and spaciously arranged, which will allow the operator of the keyboard who desires to have long fingernails to comfortably and efficiently operate an electronic keyboard. It is comprised of the usual keyboard mechanism, but having long, slender keys.

The object of the invention is to allow the operator of the keyboard who desires to have long fingernails to comfortably and efficiently operate an electronic keyboard, thus typing in an unimpeded fashion, as well as to provide keys which permit all operators of keyboards to vary the anterior-posterior position of the plane they use their keyboards in. Also, because of length of keys and free access which these keys provide the operator, provision has been made for activating the key with a front-back or lateral movement of the key.

DESCRIPTION OF THE PREFERRED EMBODIMENT

Figure 1:
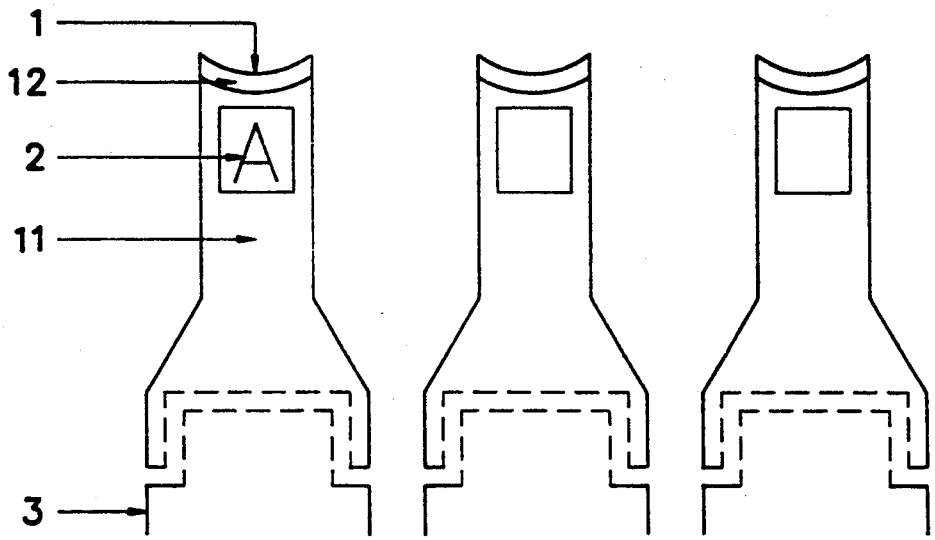
FIG. 1 is a front view of the nail saver key caps of an electronic keyboard.
Figure 2:
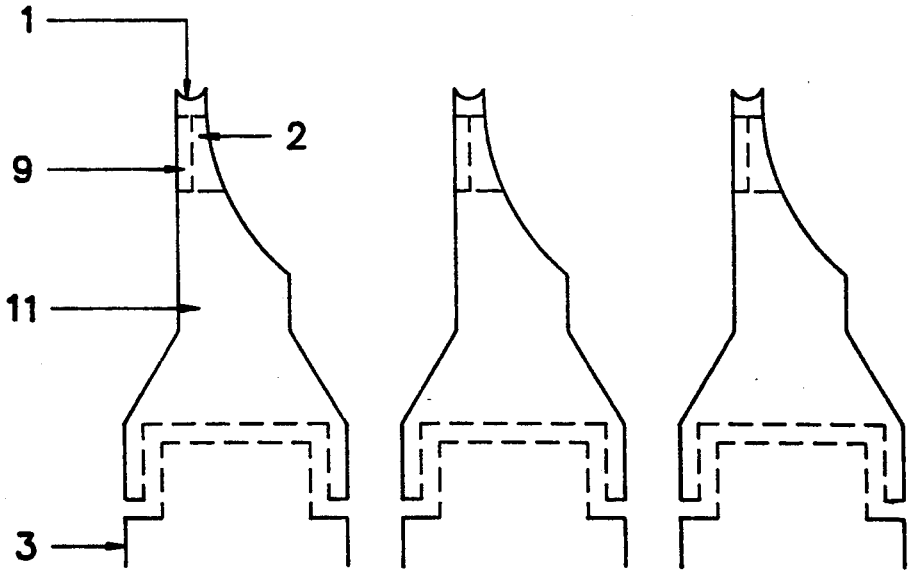
FIG. 2 is a side view of the nail saver key caps of an electronic keyboard.
Figure 11:
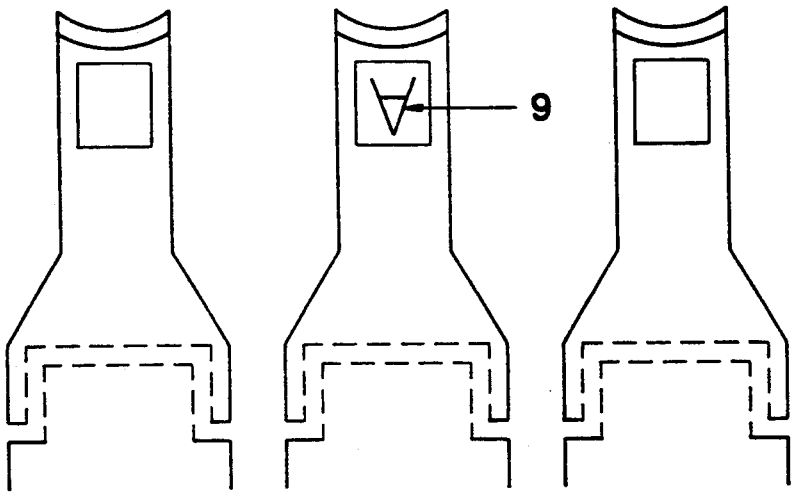
FIG. 11 is a back view of nail saver key caps of an electronic keyboard.

FIGS. 1,2, and 11 depict the built-into-the-keyboard embodiment of nail saver keys. These would replace standard plastic key caps. The typist with long fingernails would have ample surface to strike the key on the concave top surface 1. Wear and tear on the character marked onto the key would be eliminated because of its frontal position 2 and rear position 9, which is upside-down. The internal key mechanism 3 would be engaged by the key covers.

Figure 3:
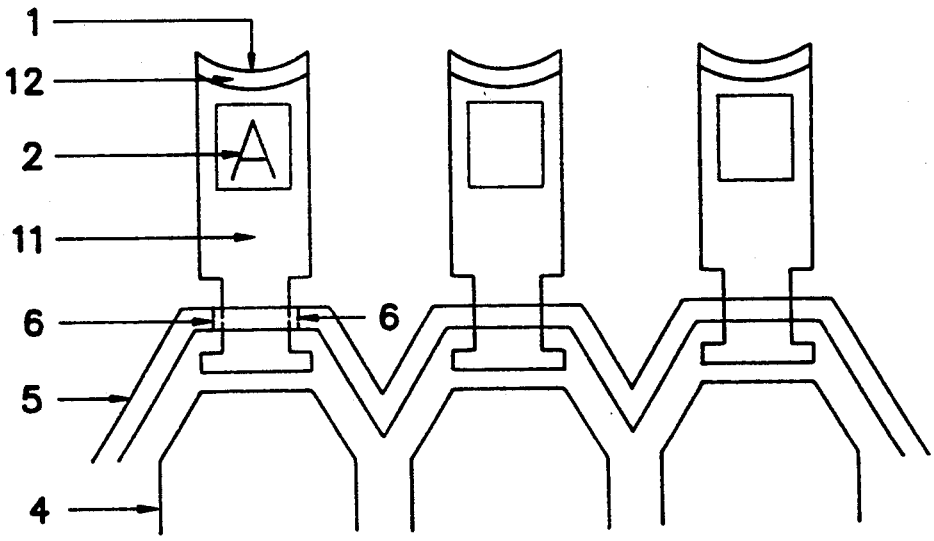
FIG. 3 is a front view of a semi-rigid keyboard cover with extension nail saver keys.
Figure 4:
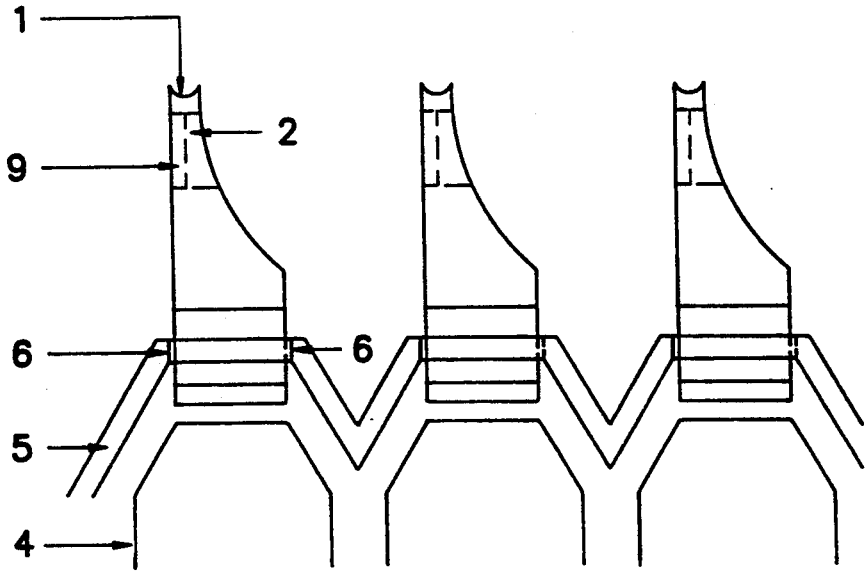
FIG. 4 is a side view a of a semi-rigid keyboard cover with extension nail saver keys.
Figure 12:
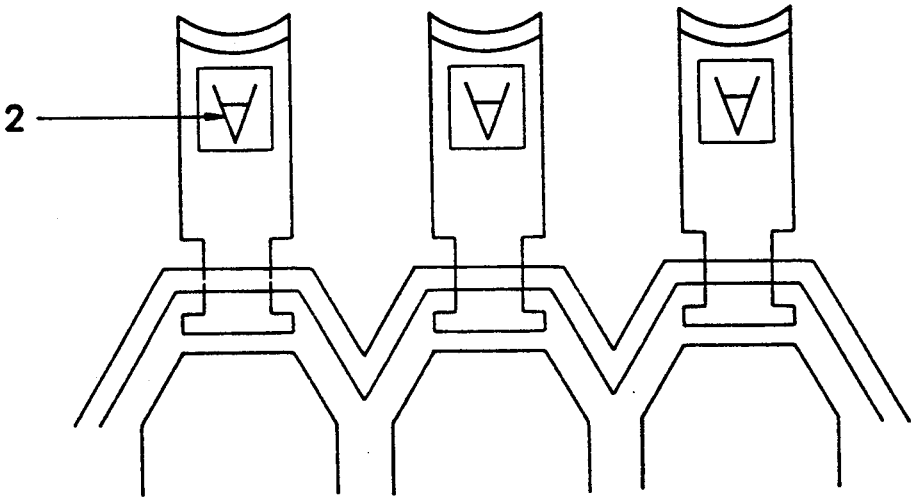
FIG. 12 is a back view of a semi-rigid keyboard cover with extension nail saver keys.

FIGS. 3, 4, and 12 depict a semi-rigid keyboard cover with extension nail saver keys. There is a movable rigid extension rod 11 with a soft rubbery top 12 which passes through an opening 6 in the semi-rigid plastic 5. This is positioned on top of the business machine key 4 and activates the said key when it is depressed by pressing on top 1 and these, as with the keys of the nail saver key caps, allow free access to the keys by the heretofore restricted, and thereby contorted, fingers of a typist with long fingernails. As in the embodiment depicted in FIGS. 1, 2, and 11, this embodiment also shows anteriorly positioned characters 2 and posteriorly positioned characters 9.

Figure 5:
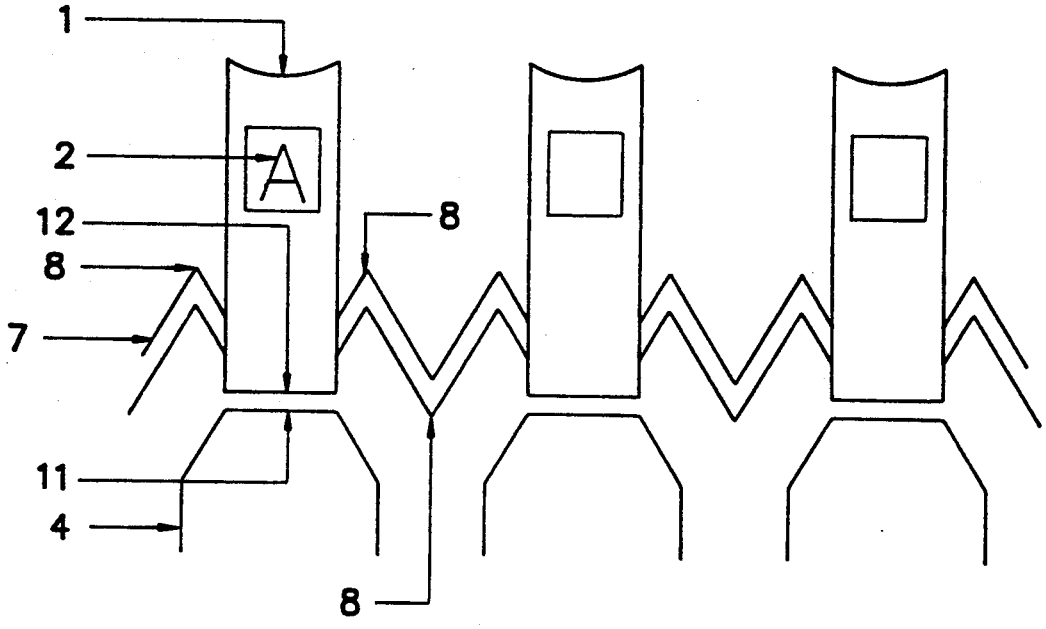
FIG. 5 is a front view of a flexible keyboard cover with extension nail saver keys.
Figure 6:
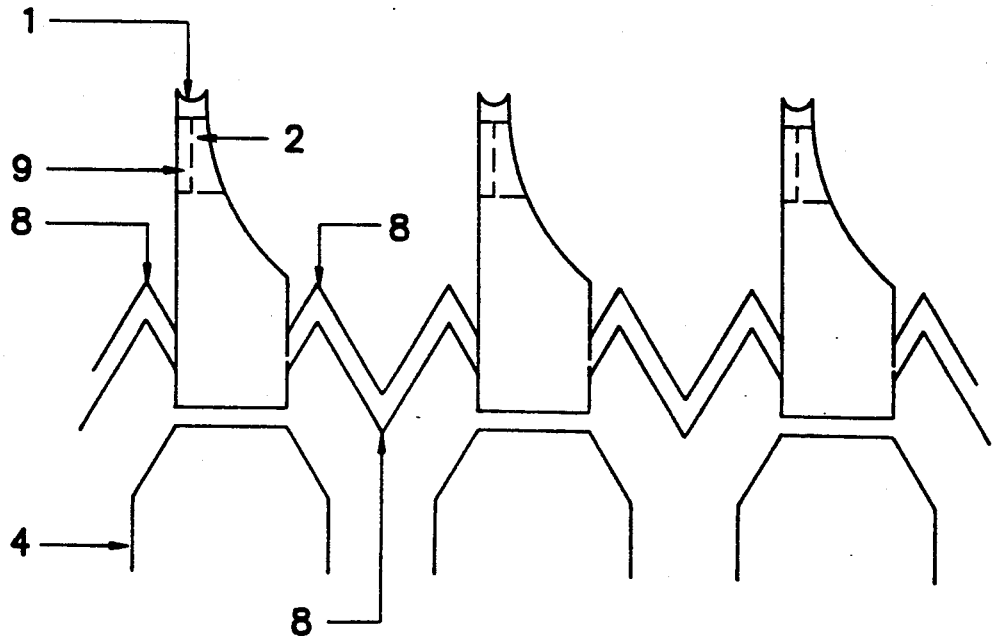
FIG. 6 is a side view of a flexible keyboard cover with extension nail saver keys.
Figure 10:
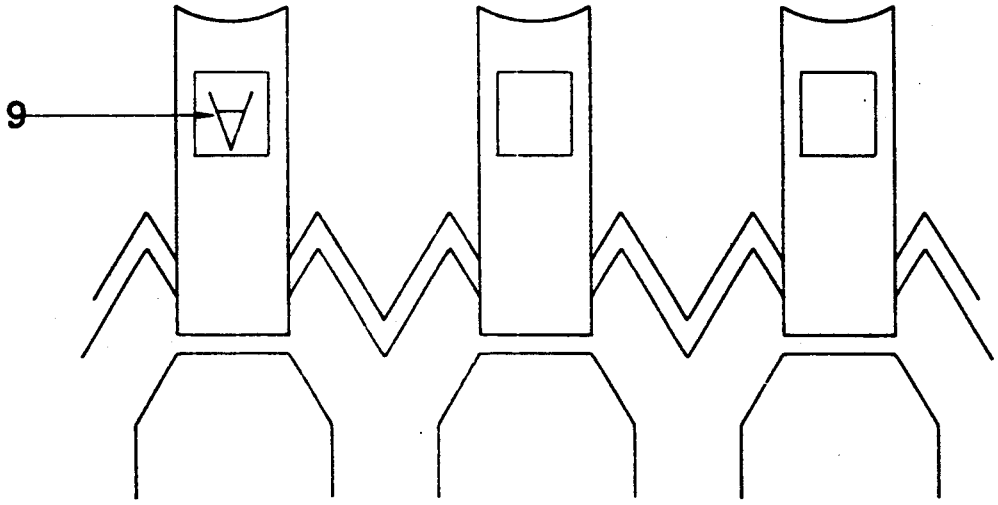
FIG. 10 is a back view of a flexible keyboard cover with extension nail saver keys.

FIGS. 5, 6, and 10 depict a flexible keyboard cover with extension nail saver keys made from. The entire device is made of a single piece of rubbery material with additional flexibility built in, in the form of convolutions in the areas between the keys which connect the structure. The whole structure is made for the specific morphology of any one keyboard, but with the base 12 of each key laying on or directly above the top 11 of each of the original keyboard's existing keys 4. This would be retained in position by the accuracy of the fit. This embodiment also provides upside-down characters 9 situated on the rear of each key.

Figure 7:
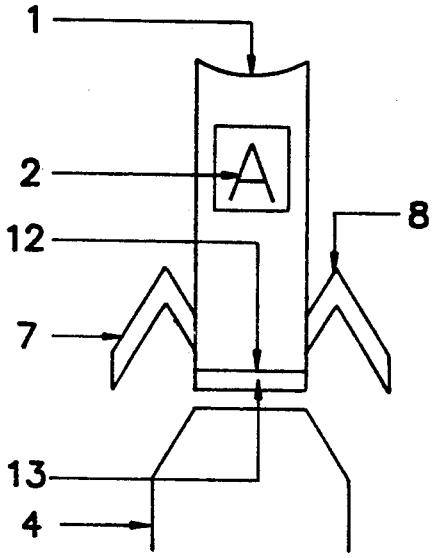
FIG. 7 is a front view of individual stick on nail saver keys.
Figure 8:
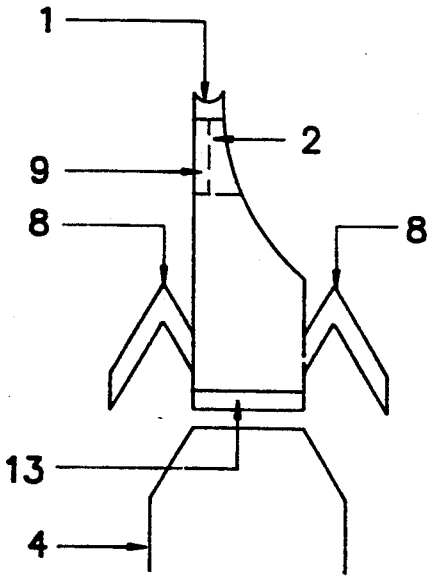
FIG. 8 is a side view of individual stick-on nail saver keys.
Figure 9:
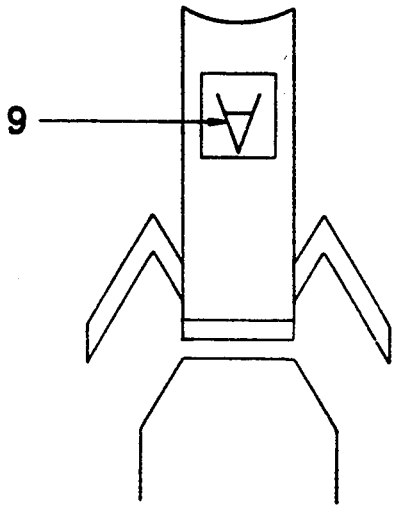
FIG. 9 is a back view of individual stick-on nail saver keys.

FIGS. 7, 8, and 9 depict the individual add-on nail saver keys. These keys are completely made of soft rubbery material. They are placed on the key caps of an existing keyboard, held in position by an adhesive 13 and simply provide for the changing of an existing keyboard's key caps into the form of a nail saver key. Because of the anterior position of the characters 2 and the posterior position of the characters 9 in each of these embodiments, positioning of the keyboard will have great flexibility, because the angle of its plane anterior-posteriorly can be positioned with substantial variation, with recognition of the character inscribed on the keys, not being impeded.

We claim:

1. A keyboard for business machines of the electronic type comprising a plurality of keys arranged in rows across the keyboard from right to left, each of said keys having an anterior wall facing an operator, a posterior wall, and a top surface, the posterior wall being substantially flat and vertical, the anterior wall being formed with a concave recess such that the distance between the posterior and an anterior walls decreases as these walls approach the top surface, the anterior and posterior walls become parallel adjacent the top surface, whereby said concave recesses in the anterior surface of the keys of one row form an area to accommodate a long fingernail, which extends from a finger placed on a top surface of a key in a row in front of said one row, so that upon depression of a key, a long fingernail will not contact any other key.

2. A keyboard, as recited in claim 1, in which said keyboard has anteriorly placed characters on the vertical concave surface of the key and posteriorly placed upside-down characters on the posterior straight vertical surface.

3. An combination keyboard and a keyboard cover for business machines of the electronic type, the cover being made of semirigid material, and having openings, each opening directly overlaying one of the underlying keyboard keys over which it is placed, said openings each housing a key extension, said extensions having an anterior wall facing an operator, a posterior wall, and a top surface, the posterior wall being substantially flat and vertical, the anterior wall being formed with a concave recess, such that the distance between the posterior and an anterior wall decreases as these walls approach the top surface, the anterior and posterior walls becoming parallel adjacent the top surface, whereby said concave recesses in the anterior surface of the keys of one row form an area to accommodate a long fingernail, which extends from a finger placed on top surface of a key in a row in front of said one row, so that upon depression of a key extension, a long fingernail will not contact any other key.

4. A keyboard cover, as recited in claim 3, in which said key extensions are mechanically retained in said openings, so as to allow vertical movement.

5. A keyboard cover, as recited in claim 4, in which said keyboard extensions have anteriorly placed characters on the vertical concave surface of the extensions.

6. A keyboard cover, as recited in claim 5, in which said keyboard extensions have anteriorly have upside-down characters placed on their posterior straight vertical surface, near the top of the key extensions.

7. A flexible cover for a keyboard comprising a plurality of key extensions interconnected by a flexible material having convolutions, said key extensions being arranged in a plurality of rows across said keyboard cover from right to left, each of said key extensions having a base, said flexible material supporting said key extensions such that the base of each key extension is positioned directly above and spaced from an associated key of the keyboard, said flexible material permitting said key extensions to be depressed into contact with and subsequently to depress its associated key, said key extensions and said flexible material consisting of a single piece of rubbery material.

8. A flexible keyboard cover, as recited in claim 7, in which said key extensions have an anterior wall facing an operator, a posterior wall, and a top surface, the posterior wall being substantially flat and vertical, the anterior wall being formed with a concave recess, such that the distance between the posterior and an anterior wall decreases as these walls approach the top surface, the anterior and posterior walls becoming parallel adjacent to the top surface, whereby said concave recesses in the anterior surface of the key extensions of one row form an area to accommodate a long fingernail which extends from a finger placed on a top surface of a key extension in a row in front of said one row, so that upon depression of a key extension, a long fingernail will not contact any other key extension.

9. A flexible keyboard cover, as recited in claim 8, in which said keyboard extensions have anteriorly placed characters on the vertical concave surface of each of the said key extensions.

10. A flexible keyboard cover, as recited in claim 9, in which said keyboard cover has upside-down characters placed on the posterior straight vertical surface of said key extensions.

11. Individual key extensions for the keys of a business machine of the electronic type, in which said key extensions comprise individual vertical sections, each of said key extensions having an anterior wall facing an operator, a posterior wall, and a top surface, the posterior wall being substantially flat and vertical, the anterior wall being formed with a concave recess, such that the distance between the posterior and an anterior wall decrease as these walls approach the top surface, the anterior and posterior walls becoming parallel adjacent to the top surface, whereby said concave recesses in the anterior surface of the individual key extensions which are in place on the keys of one row of an electronic keyboard form an area to accommodate a long fingernail which extends from a finger placed on a top surface of an individual key extension in place on the keys of the row in front of said one row, so that upon depression of an individual key extension, a long fingernail will not contact any other individual key extension.

12. Individual key extensions, as recited in claim 11, in which said key extensions have a means of attachment to said keys of a business machine of the electronic type by means of hollow bases fitting said keys, so as to allow a thin, even layer of adhesive to bind them into position.

13. Individual key extensions, as recited in claim 12, in which said individual key extensions have anteriorly placed characters on their vertical concave surface.

14. Individual key extensions, as recited in claim 13, in which said individual key extensions have upside-down characters placed on their posterior straight vertical surface.

* * * * *